US010478880B2

(12) United States Patent
Schaefer

(10) Patent No.: US 10,478,880 B2
(45) Date of Patent: Nov. 19, 2019

(54) METHOD FOR INDUCTION BEND FORMING A COMPRESSION-RESISTANT PIPE HAVING A LARGE WALL THICKNESS AND A LARGE DIAMETER

(71) Applicant: AWS SCHAEFER TECHNOLOGIE GMBH, Wilnsdorf (DE)

(72) Inventor: August Wilhelm Schaefer, Altenlotheim (DE)

(73) Assignee: AWS SCHAEFER TECHNOLOGIE GMBH, Wilnsdorf (DE)

( * ) Notice: Subject to any disclaimer, the term of this patent is extended or adjusted under 35 U.S.C. 154(b) by 0 days.

(21) Appl. No.: 15/521,333

(22) PCT Filed: Apr. 21, 2016

(86) PCT No.: PCT/DE2016/100188
§ 371 (c)(1),
(2) Date: Apr. 24, 2017

(87) PCT Pub. No.: WO2016/173583
PCT Pub. Date: Nov. 3, 2016

(65) Prior Publication Data

US 2018/0036780 A1 Feb. 8, 2018

(30) Foreign Application Priority Data

Apr. 28, 2015 (DE) ..... 10 2015 106 570

(51) Int. Cl.
*B21D 7/00* (2006.01)
*B21D 7/04* (2006.01)
(Continued)

(52) U.S. Cl.
CPC ..... *B21D 7/04* (2013.01); *B21D 7/162* (2013.01); *B21D 43/006* (2013.01)

(58) Field of Classification Search
CPC ... B21D 7/04; B21D 7/12; B21D 7/16; B21D 7/162; B21D 37/16; B21D 43/006
See application file for complete search history.

(56) References Cited

U.S. PATENT DOCUMENTS

2008/0066517 A1 3/2008 Tomizawa et al.
2012/0085138 A1* 4/2012 Kuwayama ..... B21D 7/12 72/342.6

(Continued)

FOREIGN PATENT DOCUMENTS

JP 6182452 A 7/1994

OTHER PUBLICATIONS

International Search Report of Corresponding International Application No. PCT/DE2016/100188.

*Primary Examiner* — Debra M Sullivan
(74) *Attorney, Agent, or Firm* — Robert W. Morris; Eckert Seamans Cherin & Mellott, LLC

(57) ABSTRACT

The invention relates to a method for induction bend forming a compression-resistant pipe (I) having a large wall thickness and a large diameter. According to said method, in an initial phase t1, an initial tangent (3) of the pipe (I) is heat-treated by pushing the initial tangent (3) through the inductor (20) without the intervention of the bending lock (31). At the end of the initial tangent (3) the advance of the pipe is stopped at a time t2, and the inductor (20) is moved along the pipe (I) counter to the advance direction while the bending lock (31) is closed on the pipe (I). In order to induce the bending process in a phase t3, the movement speed of the inductor (20) is reduced to zero and the latter is moved to its bending position. At the same time, the advance of the pipe (I) is started. In a phase t4, a pipe bend (4) is produced at a constant process advance speed of the pipe (I). In a phase t5, the advance speed of the pipe (I) is reduced and the inductor (20) is accelerated counter to the advance direction while the (Continued)

bending lock (31) is opened. In a phase t6, a final tangent (5) is heated by further advancing the inductor in the opposite direction.

5 Claims, 5 Drawing Sheets

(51) Int. Cl.
*B21D 7/16* (2006.01)
*B21D 43/00* (2006.01)

(56) References Cited

U.S. PATENT DOCUMENTS

| | | | | |
|---|---|---|---|---|
| 2012/0167651 | A1 | 7/2012 | Tomizawa et al. | |
| 2013/0000375 | A1* | 1/2013 | Okada | B21D 7/12 72/364 |
| 2014/0007639 | A1 | 1/2014 | Schaefer | |

* cited by examiner

METHOD FOR INDUCTION BEND FORMING A COMPRESSION-RESISTANT PIPE HAVING A LARGE WALL THICKNESS AND A LARGE DIAMETER

BACKGROUND OF THE INVENTION

The invention relates to a method for induction bend forming a pressure-resistant pipe having a large wall thickness and a large diameter, in particular a pipe in a power plant or a liquid or gas pipeline.

For carrying liquid and gaseous media under pressure, steel pipes are required that have a large wall thickness in order to withstand the stresses. Such requirements apply, for example, to the transport of hot steam in power plants, where pipe bends are required in order to adapt the pipelines to the constructional circumstances or for transporting crude oil in pipelines over long distances, where flexible U-shaped expansion loops are used at regular intervals to compensate for thermally induced changes in length. To enable a large throughput, a large opening cross-section and correspondingly a large outer pipe diameter is required. The present method relates to pipes with typical nominal diameters greater than 300 mm and a diameter to wall thickness ratio of 10:1 to 100:1, typically 20:1 to 70:1.

Such a method for induction bend forming has long been known, for example from DE 2513561 A1 and has been continually improved in order to produce dimensionally very stable pipe bends despite the enormous dimensions. Forming of such massive pipes can only be achieved by inductively heating a narrow annular zone to a forming temperature above 850° C. Structural changes occur in the material, which is usually fine-grained steel, in the heat-affected zone. In order to homogenize the structure after hot forming and thus improve the mechanical properties of the steel, the pipe bend is subsequently often heat-treated at a temperature of about 600° C. The straight pipe sections, which are connected before and after the pipe bend and are also referred to as tangents, are also influenced by the subsequent heat treatment. However, since they were not heated to a high temperature in the course of the forming process and their structure has, therefore, remained unchanged, the subsequent heat treatment has a negative effect on these sections; they embrittle. Thus, these sections must be separated, and the pipe bend produced by induction bend forming has to be welded to new tangents.

This has disadvantages because of the high work effort, in particular when a plurality of pipe bends, even in different directions, are carried out successively on the same pipe piece, as made possible by the device described in DE 10 2010 020 360 A1. The simplification and acceleration of pipeline construction thus achieved by producing a three-dimensional pipe structure in only one operation is negated if the straight tangent pieces have to be replaced because a thermal post-treatment of the pipe formation necessary in order to achieve certain strength values. To avoid this, only the use of pipes of high-strength steels and/or of greater wall thickness is possible in order to retain the mechanically required minimum strength values for the overall structure after the heat treatment at the tangents. However, this approach is also disadvantageous because of considerably higher material prices.

SUMMARY OF THE INVENTION

The problem addressed by the present invention is thus to improve the method of the aforementioned kind in such a way that negative influences of the forming process on the strength values of the material in the tangents adjoining the pipe bends are avoided.

The solution approach according to the invention is based on subjecting the tangents before and after the bend to exactly the same heat treatment that the bend section of the pipe has to undergo during forming, i.e., to pass the tangents through the induction device at the same speed as the pipe section to be bent and to apply the same temperature in the induction device as well as the same cooling parameters thereafter. The difference in the pass-through of the tangents is therefore simply that the pipe is not clamped in the bending lock during the treatment of the tangent and therefore no counter-forces are in effect during the feed.

Clamping only the rear end of the pipe without any further support makes it possible to operate independently of the clamping of the front end in the bending lock and furthermore allows the inductor to move freely in the direction of the rear end along the pipe wall unobstructed by support devices.

The solution according to the invention provides for an exact adjustment of the movements of the feed unit and of the inductor, which is executed and monitored by a control unit. For a full understanding of the present invention, reference should now be made to the following detailed description of the preferred embodiments of the invention as illustrated in the accompanying drawings.

DESCRIPTION OF THE PREFERRED EMBODIMENTS

Figure 1:
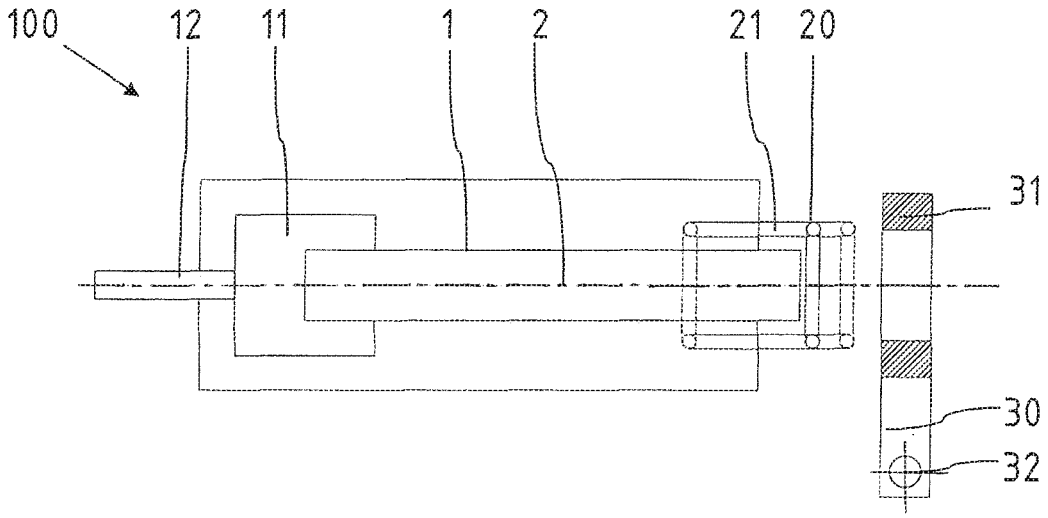
FIG. 1 is a schematic view of an induction pipe-bending device.

The preferred embodiments of the present invention will now be described with reference to FIGS. 1-4 of the drawings. Identical elements in the various figures are designated with the same reference numerals.

FIG. 1 shows an induction pipe-bending device 100 comprising a stationary machine bed 10 on which a holding device 11 for a pipe 1 is arranged. The holding device 11 grips the pipe 1 at its rear end and clamps it tightly. In addition, the holding device 11 can be moved in relation to the machine bed in the direction of a pipe center axis 2, which at the same time indicates the feed direction. The feed is carried out via a hydraulic unit 12.

An induction device comprises an annular inductor 20, which is positioned with its center in the region of the pipe center axis 2. According to the invention, a linear adjusting device 21 is provided in order to move the inductor 20 relative to the machine bed 10.

A bending arm 30 is pivotally supported at a vertical bending axis 32, wherein the distance of the bending axis 32 perpendicular to the pipe center axis 2 can be adjusted in order to set the desired bending radius. A bending lock 31 for gripping and clamping the pipe 1 is arranged on the bending arm 30.

Relatively close to the inductor 20 and the heat inflow zone is a cooling device 40, with which the surface temperature is cooled down, for example using water, as soon as the corresponding length section has emerged from the forming zone.

Sensors for capturing the path and speed of the pipe 1 as well as of the inductor ring 20 are provided for carrying out the method according to the invention, as well as control modules in a control unit with which the paths and speed, as well as the connection and disconnection of the inductor unit, are brought into the correlations provided according to the invention.

FIGS. 2*a* to 2*d* show various stages during the execution of the method. FIG. 3 shows the time points or phases t1 to t6 associated with the illustrations in FIGS. 2*a* to 2*d* in a diagram in which the upper graph indicates the speed of the feed device or the longitudinal feed rate $v_R$ of the pipe 1 against the path, and the lower graph the travel speed $v_I$ of the inductor across the path. Positive speed values correspond to a movement in the feed direction; negative values indicate a counter-movement.

Figure 2A:
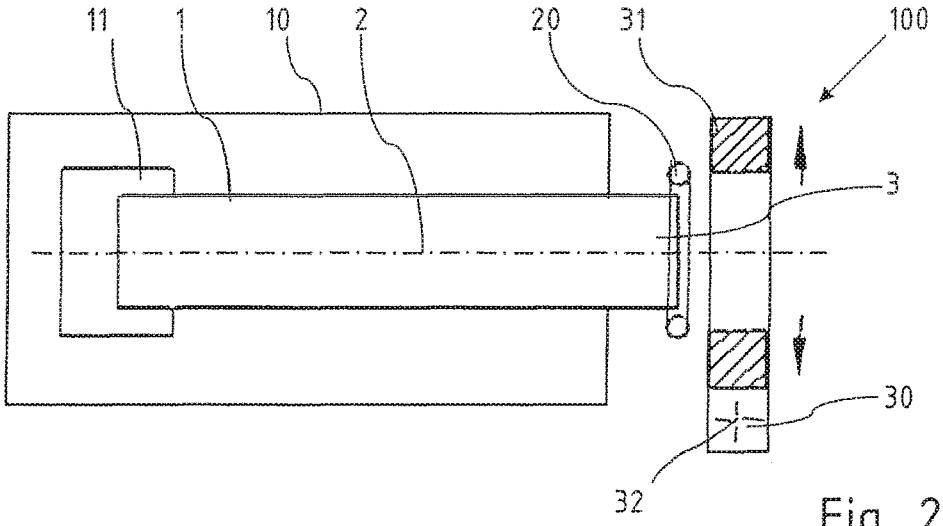
FIGS. 2*a*-2*d* show the induction pipe-bending device of FIG. 1 in respective different positions during execution of the method.
Figure 3:
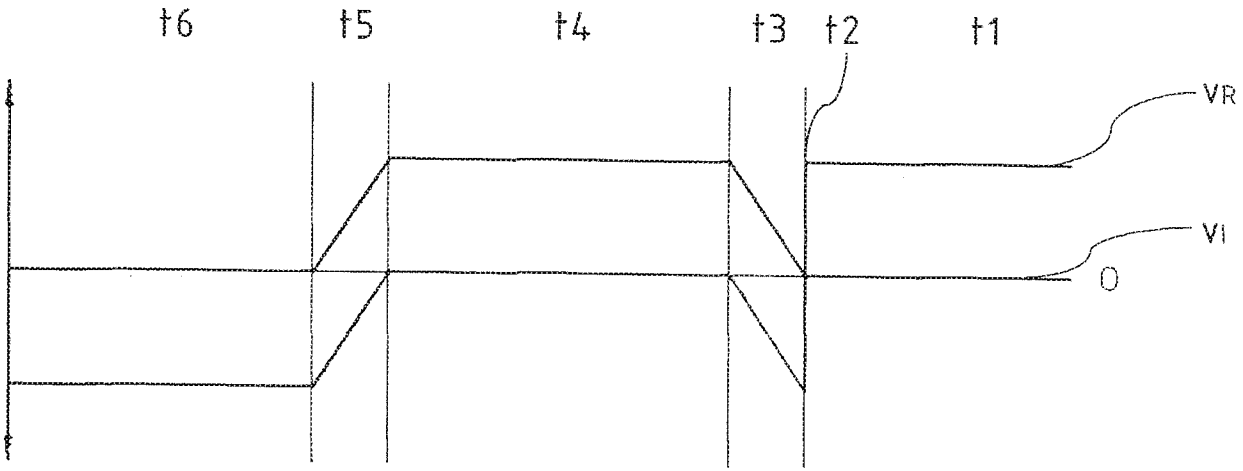
FIGS. 3 and 4 are each a flow chart, in which movement speeds are plotted against the path.

At the starting time shown in FIG. 2*a*, the front end of the pipe is pushed into the inductor ring 20, which is located at its actual starting position. In contrast to induction bend forming according to the prior art, the front pipe end, which also forms the front tangent 3 later on the formed pipe bend, is not yet secured in the bending lock 31.

The induction device 20 and the cooling device are switched on and the axial advance of the pipe 1 takes place in a first phase (see FIG. 3) with a constant pipe feed rate $v_R$. It is typically 3 mm-200 mm per minute. As a result, the tangent 3 is heat-treated on the pipe in the same way as in the subsequent forming, however, without an actual forming taking place. This phase is designated as t1 in the time-speed diagram in FIG. 3. As can also be seen here, there is no travel speed $v_I$ of the inductor 20; it is, therefore, stationary.

In order to begin the bending process, the bending lock 31 on the bending arm 30 must grip the pipe 1 and clamp it so that the forces, which lead to the bending, can be introduced. However, the approach of the bending lock 31 and the application of the clamping forces require a certain period of time. A relative movement between the bending lock 31 and the pipe 1 must be avoided during the approach. The bending arm 30 with its bending lock 31 cannot be moved parallel to the advance of the pipe 1 because the structural effort for such a longitudinal movement of the support for the bending arm 30 would be much too high and because the distance of the bending lock 31 from the heating zone on the inductor ring 20 would change.

Therefore, according to the invention, the relative movement between the pipe 1 and the bending lock 31 is to be neutralized in a short phase t2 (see FIG. 3) by stopping the pipe feed, that is, the pipe feed rate $v_R=0$, and simultaneously keeping the advance of the pipe 1 relative to the inductor 20 in that the latter is moved with a travel speed $v_I$ opposite to the direction of advance and with the same magnitude of the speed $v_R$ as the pipe feed. Inasmuch as a gradual, linear deceleration of the mechanical pipe feed is necessary, the backward movement of the inductor 20 begins at the same time, so that the relative speed is always constant, which can be seen in consistent distances of the two graphs for $v_R$ and $v_I$ in FIG. 3.

Figure 2B:
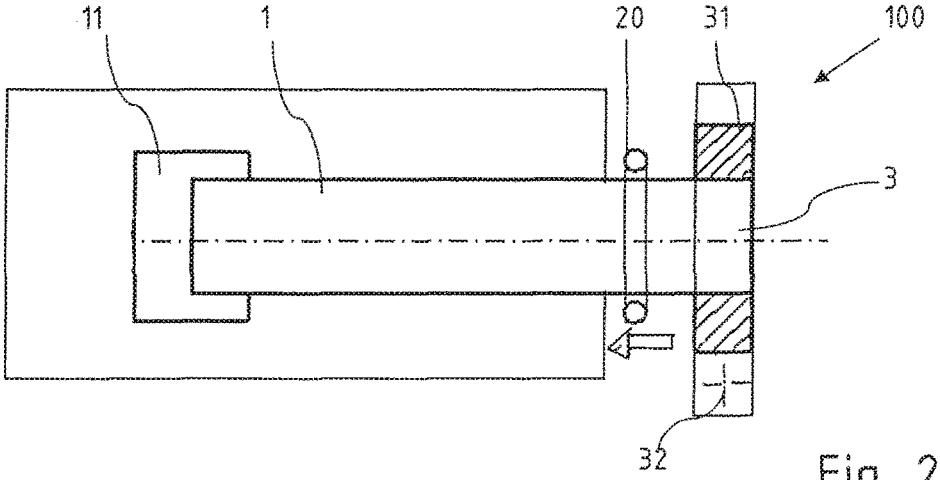

When the pipe 1 is at a standstill, the bending lock 31 can be moved in, as shown in FIG. 2*b*. During this time, the inductor 20 continues its counter-movement with a constant travel speed $v_I$. As soon as the bending lock 31 has clamped the pipe 1, the inductor speed $v_I$ is returned to zero in phase t3 and at the same time, the pipe feed rate $v_R$ of the pipe 1 is increased linearly. The speed difference $\Delta v=v_R-v_I$ is always the same so that the throughput speed of each differential length section of pipe 1 through the inductor 20 is the same and thus always the same energy from the inductor acts upon the pipe jacket. During the phase t3, the inductor 20 moves back into its starting position, which corresponds to the working position for the bending process.

If a pipe bend is to be produced, the initial point of the bend, which is present at the end of phase t3, can lie arbitrarily on the longitudinal axis 2 of pipe 1. On the other hand, the above-described operations at t1, t2, and t3 must be started with a precisely calculated approach so that a certain axial pipe position for the beginning of the bending process is reached when bending begins.

Figure 2C:
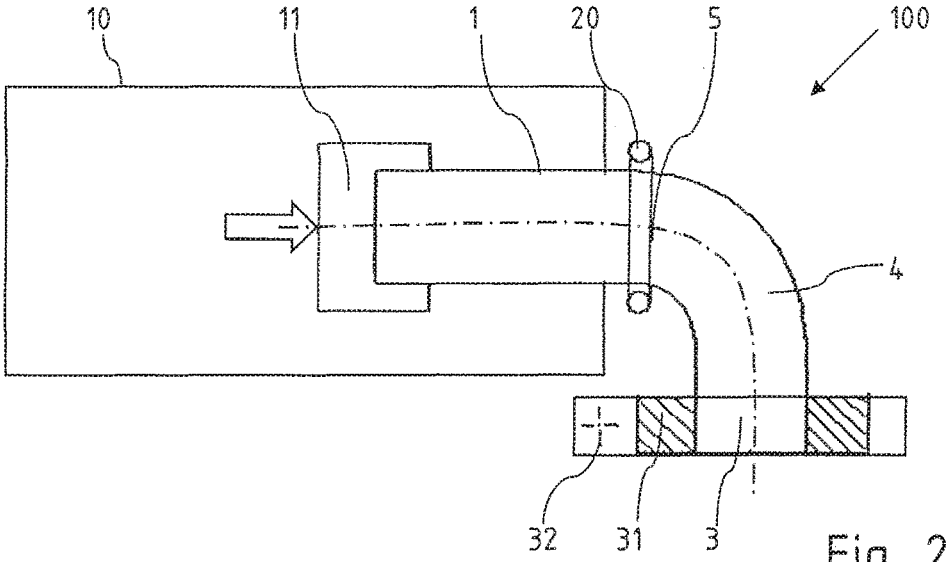

During the phase t4, the known induction bending process is carried out with a constant pipe feed rate $v_R$ and a stationary inductor 20, as shown in FIG. 2*c*, to produce a pipe bend 4.

In order to subject a rear tangent 5 on the pipe 1 to the same heat treatment as the remaining length sections of pipe 1 after the completion of the pipe bend 4, the pipe 1 and the inductor 20 move in opposite directions to the above-described starting process.

Shortly before reaching the intended bend length, the pipe feed is gradually slowed down in phase t5 at the speed $v_R$ and at the same time, the opposing movement of the inductor 20 starts at such a travel speed $v_I$ that the relative movement between the pipe 1 and inductor 20 remains constant. As a result, the residence time of each length section of the pipe 1 also remains constant in the migrating heat-affected zone. When the pipe 1 is at a standstill, the bending lock 31 can be opened. As a result, pipe 1 is now completely unobstructed by the bending arm 30.

Figure 2D:
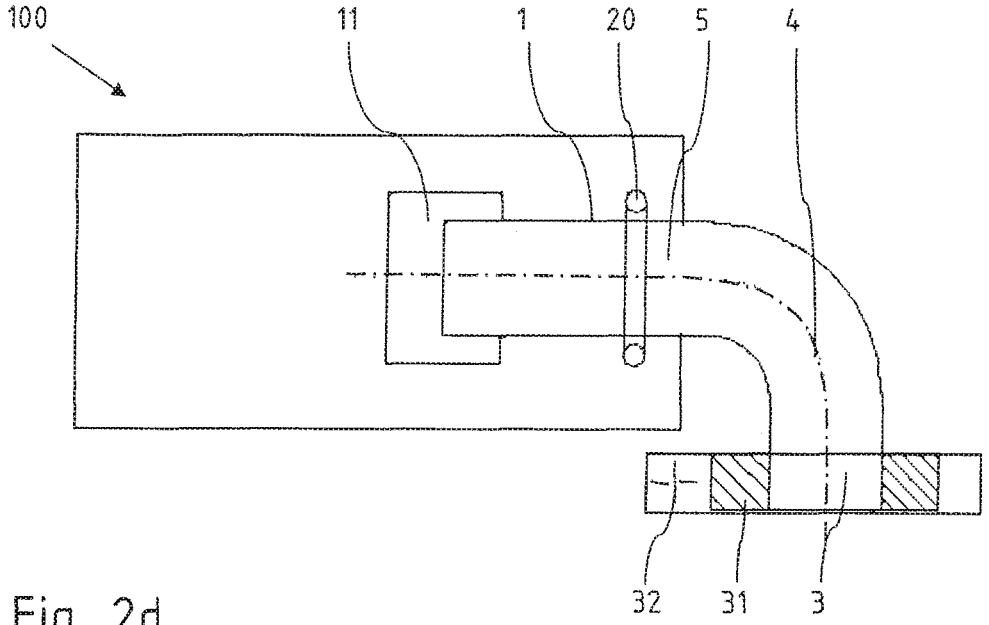

To treat only a short end-side tangent 5 on the pipe 1, the inductor 20 can be moved simply into its end position facing the machine bed 10 in phase t6 with a constant travel speed $v_I$, see FIG. 2*d*. There, the inductor 20 is then stopped and the induction device is switched off. The non-heat-treated remaining piece of the pipe 1 is marked and separated immediately, but at the latest after the heat treatment of the pipe bend 3 thus produced with its end-side tangent sections 3, 4.

Figure 4:
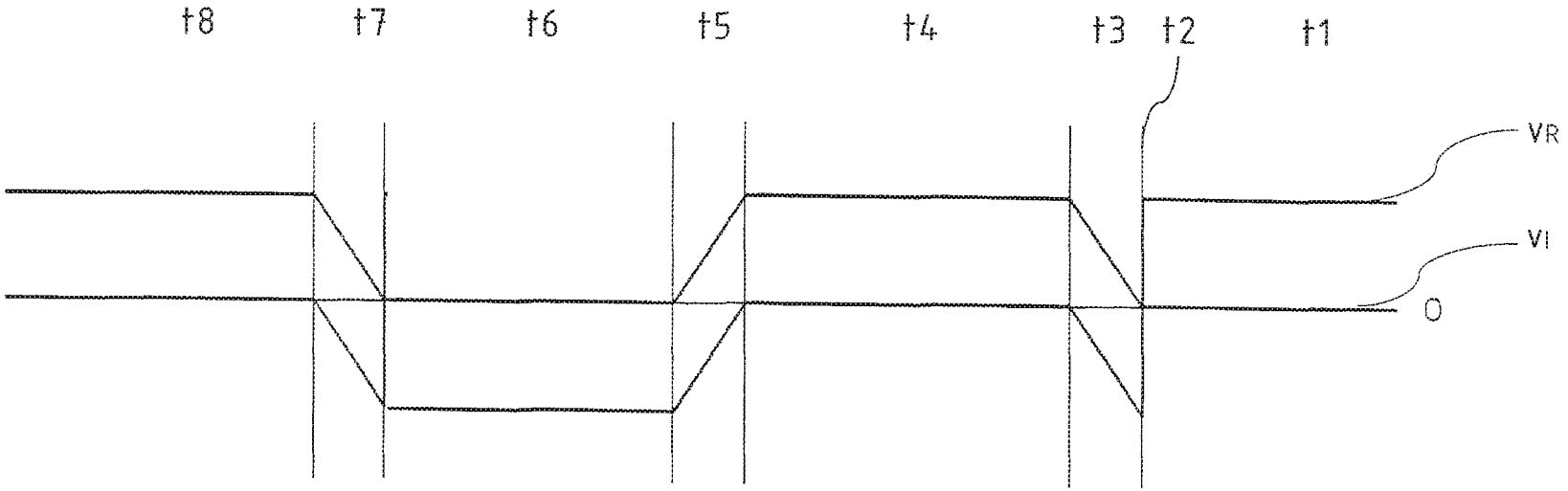

In order to obtain a longer tangent 5, in particular a tangent 5 followed directly by a further pipe bend, the method can be continued, as can be seen from the further flow chart according to FIG. 4. For this purpose, the longitudinal feed of the pipe 1 is gradually taken up in phase t7, in the same manner as in phase t3, and the inductor 20 is returned to its starting position. The heat treatment of the tangent 5 can then be continued in phase t8 at a constant pipe feed rate $v_R$ as long as is necessary to obtain a sufficiently long, heat-treated tangent 5. The bending lock 31 is not involved in this phase. Phase t8 thus corresponds to phase t1.

There has thus been shown and described a novel method for induction bend forming a pressure-resistant pipe having a large wall thickness and a large diameter, which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A method for induction bend forming a pressure-resistant pipe, having a large wall thickness and a large diameter, said method comprising:

supporting a pipe on a machine bed;

clamping the pipe with its rear end in a holding device, wherein the holding device is supported moveably in a first direction of a longitudinal pipe axis;

supplying current to an annular inductor of an induction device;

feeding the pipe through the annular inductor with a pipe feed having a speed $v_R$ while heat-treating, at a phase t1, a starting tangent of the pipe by pushing the starting tangent through the inductor without engagement of the bending lock, wherein heat treating further comprises the pipe feed speed $v_R$ being increased by a travel speed $v_I$ of the inductor;

stopping, at a phase t2, the pipe feed at the end of the starting tangent and moving the inductor along the pipe counter to a second direction that is opposite the first direction;

reducing, at a phase t3, the travel speed $v_I$ of the inductor to zero in order to initiate bending of the pipe;

moving the inductor to a bending position for the pipe and clamping the front pipe section in a bending lock, the bending lock being supported on a bending arm that can pivot around a vertical axis of rotation arranged on a side of the pipe, wherein moving the inductor occurs at the same time the feed of the pipe begins until the pipe feed speed $v_R$ is reached;

producing, at a phase t4, a pipe bend at the pipe feed speed $v_R$ of the pipe by deflecting the bending arm through a longitudinal advance of the pipe until the pipe bend is completed;

reducing, at a phase t5, the pipe feed speed $v_R$ and accelerating the inductor counter to the second direction, wherein the bending lock is opened; and heating, at a phase t6, an end tangent by further advance of the inductor in an opposite direction from the first direction.

2. The method of claim 1, wherein, prior to moving the inductor into its bending position, the inductor is moved into a starting position, which, viewed in the second direction, is located before the bending position.

3. The method of claim 2, wherein, prior to starting phase t1, the inductor is moved toward its starting position from a rearward position, viewed in the second direction.

4. The method of claim 2, wherein heat treating further comprises moving the inductor toward its starting position during phase t1 from a rearward position, viewed in the second direction.

5. The method of claim 1, wherein the relative speed, the relative speed being the difference between the pipe feed speed $v_R$ and the travel speed $v_I$ of the inductor, is constant throughout phases t1 to t6.

* * * * *